United States Patent [19]

Lyons

[11] Patent Number: 4,651,620

[45] Date of Patent: Mar. 24, 1987

[54] METHOD AND APPARATUS FOR MAKING MESH STRUCTURE

[75] Inventor: Nicholas L. Lyons, North Woodchester, England

[73] Assignee: Richard Percival Fearnley, Gloucestershire, England

[21] Appl. No.: 671,481

[22] Filed: Nov. 14, 1984

[30] Foreign Application Priority Data

Nov. 18, 1983 [GB] United Kingdom ..... 83 30910

[51] Int. Cl.[4] ..... D04G 1/02

[52] U.S. Cl. ..... 87/12; 87/53; 289/1.2; 289/1.5; 289/18.1

[58] Field of Search ..... 87/12, 53; 289/1.2, 289/1.5, 2–4, 17, 18.1

[56] References Cited

U.S. PATENT DOCUMENTS

| | | | |
|---|---|---|---|
| 3,041,915 | 7/1962 | Ryffel | 87/12 |
| 3,129,632 | 4/1964 | Starr | 87/12 |
| 3,899,620 | 8/1975 | Roeloffzen | 428/112 |
| 4,158,985 | 6/1979 | Looker et al. | 87/12 |
| 4,445,417 | 5/1984 | Iijima et al. | 87/12 |

FOREIGN PATENT DOCUMENTS

| | | |
|---|---|---|
| 231962 | 4/1925 | United Kingdom . |
| 1074621 | 7/1967 | United Kingdom . |
| 1110793 | 4/1968 | United Kingdom . |
| 1381006 | 1/1975 | United Kingdom . |
| 1402781 | 8/1975 | United Kingdom . |

*Primary Examiner*—John Petrakes

*Attorney, Agent, or Firm*—Collard, Roe & Galgano

[57] ABSTRACT

A mesh structure comprises intersecting elongate members with each node at which they intersect being on the boundaries of four apertures in the mesh structure. One of said members has a locus which first defines the boundary between a first of said apertures and a second of said apertures, then transits said node and defines the boundary between a third of said apertures and the fourth of said apertures. The other of said members has a locus which first defines the boundary between said second and said third apertures, then transits said node and defines the boundary between said fourth and said first apertures. Said loci or said one member and said other member while transiting said node have such configurations that said members are knotted together. A method of manufacture comprises forming a system of loops in each of a plurality of warp members, inserting a weft member through each of said loop systems consecutively, and drawing tight said warp members so that said loop systems are tightened around the weft member. The configurations of said systems of loops are such that after tightening thereof each said warp member becomes knotted to the weft member. Apparatus operates to perform the foregoing method and thereby manufacture the mesh structure.

6 Claims, 11 Drawing Figures

METHOD AND APPARATUS FOR MAKING MESH STRUCTURE

BACKGROUND OF THE INVENTION

1. Field of the Invention

The invention relates to knotted mesh structures, and to methods and apparatus for the manufacture thereof.

2. Description of the Prior Art

Mesh structures in the form of nets are well known which are constructed of flexible members knotted together. The conventional form of such a net is shown diagrammatically in FIG. 1 of the accompanying drawings, where the locus of a typical member as it passes from knotted junction to knotted junction is shown by arrows 1; the locus of a neighbouring member is shown by arrows 2. Such a structure is unsuitable if, for instance, it is required that the member portions lying in one direction should have different properties from those lying in the transverse direction.

A suitable structure meeting this requirement is shown in FIG. 2 of the accompanying drawings, where the loci of two typical members are shown respectively by the arrows 3 and 4 and the member 3 may have different properties from the member 4. Such a difference in properties is, for instance, required for electrified fence netting for the control of animals where it is desirable that the horizontal members are electrical conductors and the vertical members electrical insulators. It may also be desirable that the vertical members are more rigid than the horizontal members.

It has previously been proposed in UK Pat. No. 1,110,793 to construct such a net by surrounding the members in the region of each junction by a mass of moulded thermoplastics material, as an alternative to knotting. Such a structure has disadvantages: if the members are sensitive to heat they are liable to be weakened by the heat evolved by the moulding process; members are liable to slip through the moulded junctions when loaded unless the masses of moulded material are large; and the rate of production is limited by the inherent slowness of the moulding process.

SUMMARY OF THE INVENTION

The objects of the invention are to overcome the aforesaid disadvantages by providing mesh structures of the type shown in FIG. 2 but having knotted junctions, and a method and apparatus for making such structures.

According to a first aspect of the invention there is provided a mesh structure a representative region of which comprises intersecting elongate members (the places where said members intersect hereinafter being referred to as "nodes") with each node within the boundary of the region being characterized as follows: said node is the intersection between two portions of said members; said node is on the boundaries of four apertures in the mesh structure; a first of said member portions has a first locus which first defines the boundary between a first of said apertures and a second of said apertures, then transits said node and then defines the boundary between a third of said apertures and the fourth of said apertures; the second of said member portions has a second locus which first defines the boundary between said second aperture and said third aperture, then transits said node and then defines the boundary between said fourth aperture and said first aperture; said first locus and said second locus while transiting said node having such configurations that said first member portion and said second member portion are knotted together.

Usually each aperture in the structure will have four nodes in its boundary and be of rectangular form. The structure is preferably elongate with the longitudinal warp members of the structure being knotted to the lateral weft members of the structure.

According to a second aspect of the invention there is provided a method of manufacturing mesh structures, comprising forming a system of loops in each of a plurality of warp members; inserting a weft member through each of said loop systems consecutively; and drawing tight said warp members whereby said loop systems are tightened around said weft member, the configurations of said systems of loops being such that after tightening thereof each warp member becomes knotted to said weft member.

The weft members may be sufficiently flexible to be deformed locally on tightening of the loop systems, and in this case each loop system preferably comprises three loops arranged in a double figure-of-eight formation before tightening.

Alternatively the weft members may be of considerable rigidity as compared with the warp members, and the method may include a step to produce indentations in the weft member which are engaged by the tightened loops of the warp members. Thus the weft member may be preformed with such indentations or, when it is of deformable material, the knot regions may be subjected to pressure to produce said deformations. With such a rigid weft member each loop system in the warp members may comprise two loops arranged in a figure-of-eight formation before tightening.

According to a third aspect of the invention there is provided apparatus for the manufacture of mesh structures, comprising a plurality of loop forming means operative to form systems of loops in a plurality of warp members; insertion means for inserting a weft member through said loop systems consecutively; and tightening means operative to tighten said loop systems around said weft member, the configuration of the loop systems formed by the loop forming means being such that as a result of said tightening each of said warp members becomes knotted to said weft member.

Other features of the invention will be apparent from the following description, drawings and claims, the scope of the invention not being limited to the drawings themselves as the drawings are only for the purpose of illustrating ways in which the principles of the invention can be applied. Other embodiments of the invention which utilise the same or equivalent principles may be used and structural changes may be made as desired by those skilled in the art without departing from the present invention and the purview of the appended claims.

DESCRIPTION OF THE PREFERRED EMBODIMENTS

Figure 1:
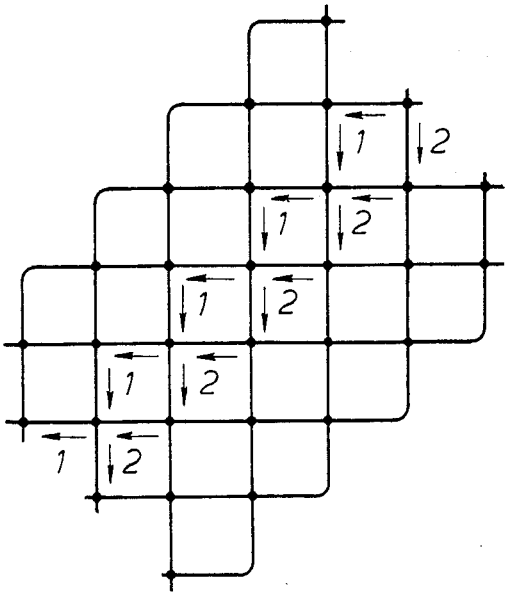
FIG. 1 shows diagrammatically a prior mesh structure.
Figure 2:
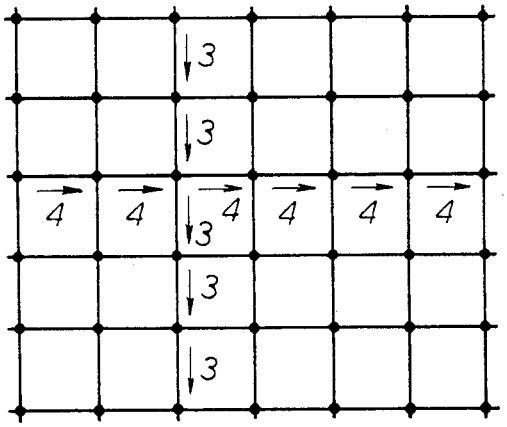
FIG. 2 similarly shows a typical mesh structure in accordance with the invention.
Figure 3:
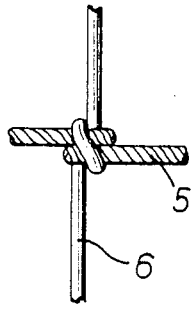
FIG. 3 is an enlarged view of a knotted junction.

The form of knotted junction illustrated in FIG. 3 shows a member 5 securely knotted to a member 6. This form of junction is suitable where both the member 5 and the member 6 are flexible. In a structure suitable for electrified fence netting for the control of animals, the horizontal warp member 5 may be a conducting twine as proposed in UK Pat. No. 1,074,621 or in UK Pat. No. 1,381,006, consisting of twine made of a number of filaments of synthetic material twisted together and incorporating one or more electrically conducting wires, with the vertical weft member 6 being an electrically insulating twine.

Figure 4:
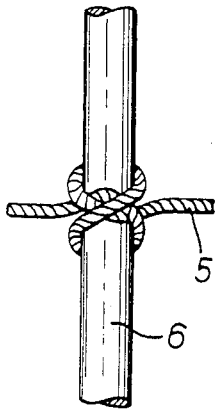
FIG. 4 is a similar view of an alternative form of knotted junction.
Figure 5:
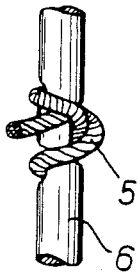
FIG. 5 showns an improvement to the knotted junction shown in FIG. 4.

If the vertical member is of high rigidity in comparison with the horizontal member then an example of a more suitable knot is as shown in FIG. 4, in which the flexible member 5 is knotted to the rigid member 6. Additional security can be obtained by engaging the knotted member with indentations in the rigid member 6 as shown in FIG. 5, which is a view of the structure looking along a flexible member 5. Such indentations can be preformed in the member 6. Alternatively, if the rigid member 6 is of deformable material, such as an orientated thermoplastic, the indentations may be formed after knotting by forcing portions of the member 5 into the member 6 by the use of a press.

Figure 6:
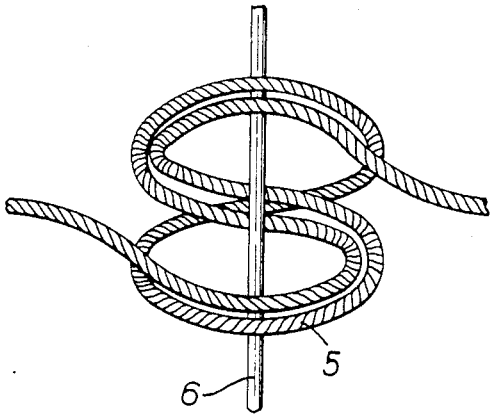
FIG. 6 shows a suitable system of loops.

FIG. 6 shows a system of loops in the warp member 5 with the weft member 6 inserted therethrough. When the warp member 5 is drawn tight the knotted junction shown in FIG. 3 will result.

Figure 7:
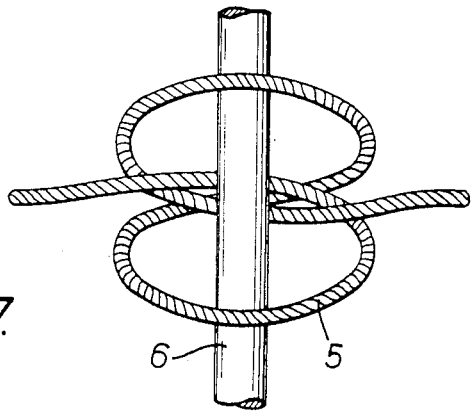
FIG. 7 shows an alternative system of loops.

FIG. 7 shows a system of loops for knotting the flexible warp member 5 to a comparatively rigid weft member 6. When the warp member 5 is drawn tight the knotted junction shown in FIG. 4 will result.

Figure 8:
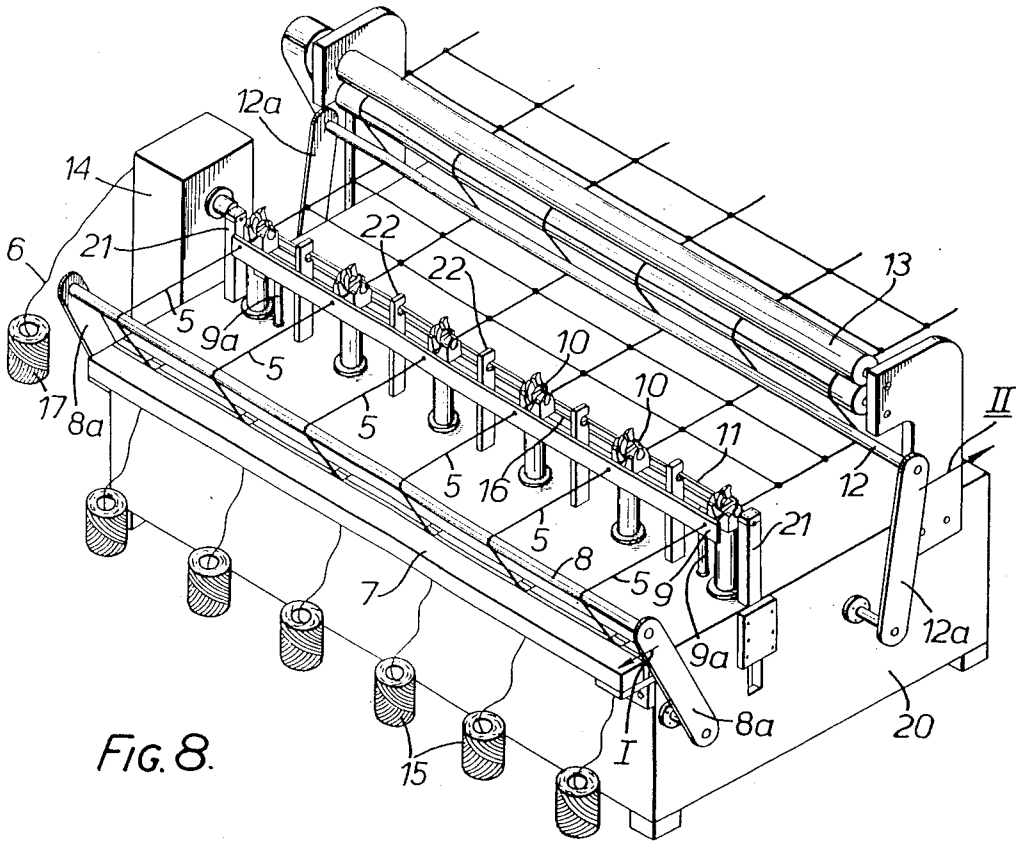
FIG. 8 is a general perspective view of apparatus in accordance with the invention.

FIG. 8 is an apparatus embodiment of the invention. In operation of the apparatus warp members 5 are taken from packages 15 by warp feeding means 7 comprising tensioning devices which enable the feed tension to be varied during the operating cycle; the warp members 5 pass over a tension bar 8 mounted between swingable arms 8*a*, through apertures in a vertically movable guide 9 mounted on support rods 9*a*, through rotatable loop formers such as 10, through a slot 16 in a vertically movable guide 11, under a tension bar 12 mounted between swingable arms 12*a*, and to haul-off 13. Moving the tension bars 8 and 12 by movement of the supporting arms 8*a* and 12*a* in the direction of the arrows I and II tensions the warp members 5 for knot formation, whereas movement in the opposite directions releases the warp members 5 for formation of loop systems. Preferably the motion of the tension bars 8 and 12 is such as to permit feeding of the warp members 5 and haul-off of the knotted net to proceed at a constant speed.

Weft feed and insertion means 14 feed and cut off the required length of weft 6 from packages 17 and insert it through the loop formers 10, slots in vertically movable weft deflectors 22 and weft grippers 21. The weft feed and cut-off means may be any of those known in weaving practice for weft insertion through a shed; such as shuttles, bolts, lances, fluid jets, nip rollers or combinations of these. Additional weft impelling means may be placed between the loop formers 10, as may guides such as conduits which are openable to permit egress of the weft 6 after knot formation. The mechanisms to provide the required motions of the various operative elements of the apparatus are housed in a base enclosure 20; they may comprise motors, cams, gears, belts and/or chains, for example, and hydraulic, pneumatic or electric actuators or servomechanisms.

Figure 9:
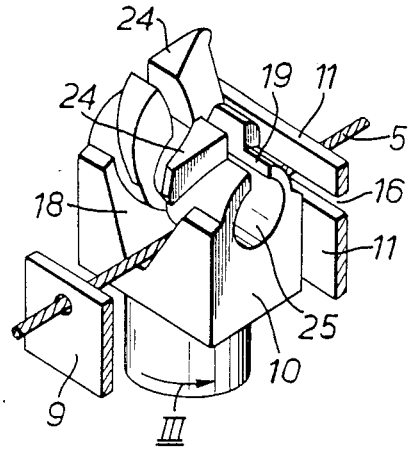
FIG. 9 is an enlarged view of loop forming means of the apparatus of FIG. 8, prior to the formation of a system of loops thereby.
Figure 10:
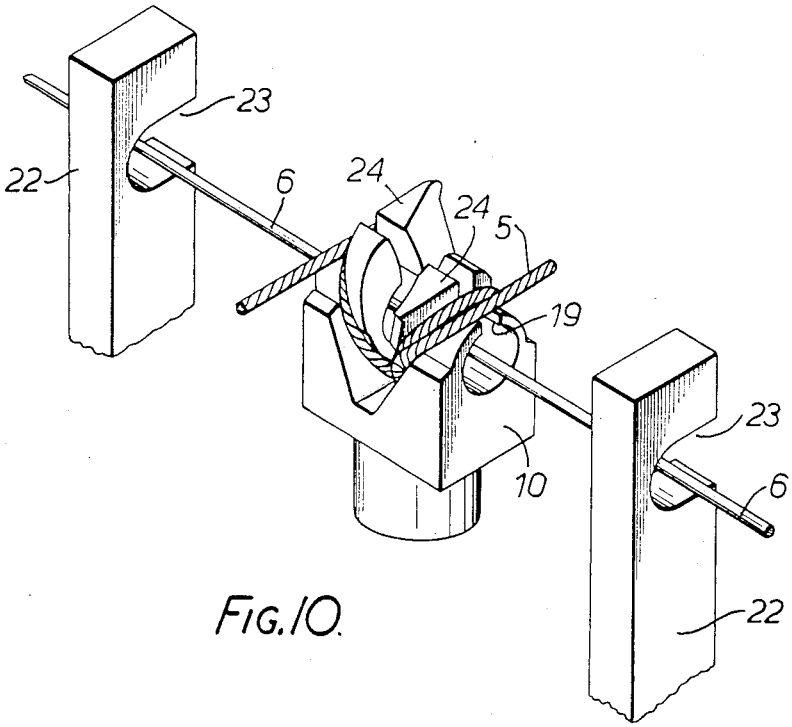

The operation of the loop formers 10 during manufacture of a mesh structure in accordance with the invention can be understood by reference to FIGS. 9 and 10. Each loop former 10 comprises two lobes 24 separated by a slot 18 which permits vertical ingress and egress of the corresponding warp member 5. A transverse conduit 25 permits insertion of the weft member 6; a slot 19 connecting with conduit 25 permits vertical egress of the weft member 6. The perforated guide 9 and the slotted guide 11 are vertically movable with respect to the loop former 10, and the loop former 10 is rotatable about its horizontal axis. In operation of the apparatus, downward movement of the guides 9 and 11 lays the warp members 5 at the bottom of the slot 18 in the loop former 10 as shown in FIG. 9. The former 10 is now rotated one full turn in the direction of the arrow III in FIG. 9, followed by one half turn in the reverse direction; simultaneously the guides 9 and 11 are given vertical motions such that the warp member 5 becomes wrapped around the loop former 10 as shown in FIG. 10; the resultant configuration of the warp member 5 is essentially as shown in FIG. 6.

The weft member 6 is now passed through the loop system and former 10 as shown in FIG. 10, and the loop system is then disengaged from the former 10.

With the loop former shape of the illustrated apparatus embodiment, disengagement of the loop system is not possible if both the warp member 5 and the weft member 6 are taut or nearly taut. Two methods of disengaging the loop systems from the formers will now be described.

According to the first disengagement method, the tension bars 8 and 12 are moved towards each other over a distance which gives a sufficient degree of slack in the warp members 5 to permit disengagement of the loop system from the loop former 10. The grippers 21 grip the ends of the weft member 6, and the weft deflectors 22 and the grippers 21 are raised whereby the weft member 8 is raised through the slot 19 and lifts the loop system off the former 10.

According to the second disengagement method, the weft deflectors 22 and the grippers 21 are lowered whereby the weft member 6 adopts a zig-zag form of increased length; the weft member 6 being drawn through the grippers 21 to provide the extra length. The grippers 21 then grip the ends of the weft member 6 and the weft deflectors 22 and grippers 21 are raised to their former level, whereby the weft member 6 becomes slack. The guides 8 and 12 are now raised sufficiently to disengage the loop system from the former 10, the weft member 6 escaping from the former 10 through the slot 19.

Tightening the warp member 5 by movement of the tension bars 8 and 12, after the loop systems have been lifted off the formers 10, results in the knotted junction shown in FIG. 3. Suitable further movements of the tension bars 6 and 12 advances the resultant mesh structure whereby the warp member 5 carries the weft member 6 through the slot 16 in the guide 11.

The knotted junction shown in FIG. 3 results in a mesh structure comprising junctions in each of which the form of each of the two members 5 and 6 which are knotted together comprises a loop, thus providing a "bight", such that a point travelling along the axis of each member 5 or 6 passes twice through the bight of the other member 6 or 5, with both passages through the bight of that other member being in the same direction.

Figure 11:
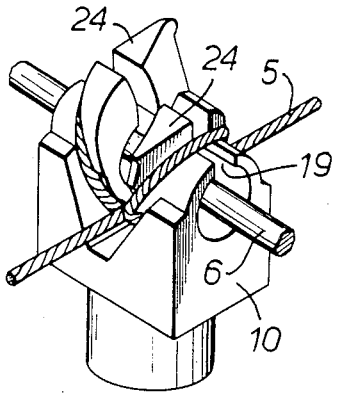
FIGS. 10 and 11 show the loop forming means after formation of the systems of loops illustrated in FIGS. 3 and 4, respectively.

If the weft member 6 is comparatively rigid so that the knotted junction shown in FIG. 4 is desired, the operation of the loop former is the same except that the final reverse half turn of the formers 10 is omitted, so that the warp member 5 becomes wrapped around the loop former 10 as shown in FIG. 11; the configuration of the warp member 5 is now essentially as shown in FIG. 7. Disengagement of the loop system from the former 10 will in this case be by the first method hereinbefore described.

The knotted junction shown in FIG. 4 results in a mesh structure comprising junctions in each of which the lateral member 6 is surrounded by two loops in the longitudinal member 5, such that points travelling in either direction along the axis of the member 5 first approach the junction, then pass between said loops, then pass between each of the two contiguous longitudinal member portions forming said loops and the lateral member, before travelling around a circuit of said lateral member 6.

I claim:

1. A method of manufacturing a mesh structure, comprising the steps of:

forming a system comprising a plurality of loops in each of a plurality of warp members;

inserting a weft member through each of said loop systems consecutively with said weft member passing through each of said plurality of loops of each said system; and drawing tight said warp members whereby said loop systems are tightened around said weft member, said systems of loops having configurations such that after tightening thereof each warp member becomes knotted to said weft member to provide a knotted junction of said mesh structure, said weft member being sufficiently flexible to distort on tightening of said loop systems, and said loop systems being such that on tightening thereof the form of each of said knotted together warp and weft members in each knotted junction of the mesh structure comprises a loop, thus providing a bight, such that a point travelling along the axis of each one of these two members passes twice and only twice through the bight of the other member thereof, with both passages through the bight of said other member being in the same direction, each of said members forming a helix at said junctions, with said helix formed by one of said loops at one junction being of opposite sense to said helix formed by said other loop at that junction.

2. A method of manufacturing a mesh structure, comprising the steps of:

forming a system comprising a plurality of loops in each of a plurality of warp members;

inserting a weft member through each of said loop systems consecutively with said weft member passing through each of said plurality of loops of each said system; and drawing tight said warp members whereby said loop systems are tightened around said weft member, said loop systems having configurations such that after tightening thereof each warp member becomes knotted to said wedt member to provide a knotted junction of said mesh structure, said weft member being of substantial rigidity as compared with said warp member, said warp member having two continuous portions forming loops, and said loop systems further being of such form that on tightening thereof a mesh structure is formed having apertures of quadrilateral form and in each said knotted junction, the corresponding weft member therein is surrounded by two loops in the corresponding warp member, such that a point travelling in either direction along the axis of that warp member first approaches the junction, then passes between said loops, then passes between each of the two contiguous warp member portions forming said loops and the weft members, before travelling around a circuit of said weft member.

3. Apparatus for the manufacture of mesh structures, comprising:

a plurality of loop forming means operative to form systems of loops in a plurality of warp members, each such system in each warp member comprising a plurality of loops;

insertion means for inserting a weft member through said loop systems consecutively, with the weft member passing through each of said plurality of loops of each said system;

said loop forming means comprising, for each said warp member, a rotary lobed loop former with two lobes around which said loops are formed and with a gap between them for ingress and egress of that warp member, with a passage through said loop former for insertion of said weft member comprising a slot disposed laterally of the rotation axis of said loop former; and tightening means operative to tighten said loop systems around said weft, the configuration of the loop systems formed by the loop forming means being such that as a result of said tightening, each of said warp members becomes knotted to said weft member to provide a corresponding knotted junction of said mesh structure.

4. Apparatus for the manufacture of mesh structures according to claim 3, further comprising tensioning means operative to relive the tension on the warp members to allow loop systems to be formed and to allow said loop systems to be disengaged from said loop formers, said tensioning means also protruding said tightening means operative to tension the warp members to tighten said loop systems around said weft member.

5. Apparatus for the manufacture of mesh structures according to claim 3, further comprising gripper means to grip the ends of the inserted weft member; and deflectors between said loop formers which are movable to cause the inserted weft member to adopt a zig-zag path through said loop formers, said deflectors being movable to cause the weft member to become slack and allow the loop systems to be removed from said loop formers.

6. Apparatus for the manufacture of mesh structures according to claim 3, wherein operating mechanisms of the apparatus are controlled to produce synchronized operation of the operative elements of the apparatus, during each cycle of operation each rotary loop former being rotated one full turn in one direction followed by a half turn in the reverse direction, or merely rotated said one full turn in said one direction.

* * * * *